United States Patent [19]

Prandini

[11] 4,162,657

[45] Jul. 31, 1979

[54] DEVICE FOR INSERTING ORNAMENTAL THREADS IN STITCHES OF SEAMS ON A SEWING MACHINE

[75] Inventor: Franco Prandini, Busto Arsizio, Italy

[73] Assignee: Rockwell-Rimoldi S.p.A., Milan, Italy

[21] Appl. No.: 929,381

[22] Filed: Jul. 31, 1978

[30] Foreign Application Priority Data

Sep. 15, 1977 [IT] Italy ..... 27546 A/77

[51] Int. Cl.[2] ..... D05C 7/08

[52] U.S. Cl. ..... 112/101

[58] Field of Search ..... 112/139, 101, 99, 100, 112/161, 302

[56] References Cited

U.S. PATENT DOCUMENTS 630,456 8/1899 Henry ..... 112/100

1,961,270 6/1934 Weis et al. ..... 112/100

2,063,995 12/1936 Galkin ..... 112/100

*Primary Examiner*—Werner H. Schroeder

*Assistant Examiner*—A. M. Falik

[57] ABSTRACT

A device for presenting ornamental threads to the stitching instrumentalities of a sewing machine for incorporating them into seams of stitches which includes one or more thread guide levers mounted adjacent the machine's needle bar.

These levers are operatively connected to a rotatably driven cam and are caused to pivot to and fro in timed sequence with the stitching cycle and to present the threads associated therewith to positions where they will be incorporated into seams of stitches formed on a workpiece.

6 Claims, 9 Drawing Figures

DEVICE FOR INSERTING ORNAMENTAL THREADS IN STITCHES OF SEAMS ON A SEWING MACHINE

BACKGROUND OF THE INVENTION

The present invention pertains to a device for the insertion of ornamental threads in the stitches of seams produced by a sewing machine.

Devices for effecting the insertion of ornamental threads within the stitches of seams are well known to those conversant in the sewing art; however, such devices are considered to be rather complex from both a constructional and operational viewpoint due to the fact that the framework of the sewing machine must be designed specifically so that it can accommodate devices of this type.

The known devices have very similar cam mechanisms for effecting insertion of the threads and are located in the vicinity of the support column which is considered to be a substantial distance from the stitching instrumentalities. Consequently, support structure is required in this area of the sewing machine to accommodate these mechanisms and the various actuating elements operatively interconnecting the latter with the thread inserting members must extend through the central portion of said machine's framework.

This arrangement contributes to the complexity of such devices for the thread inserting members must be located in front of the machine's needles to perform their intended function.

For reasons set forth above, the framework of sewing machines intended for use with the known ornamental thread inserting devices must be specifically modified to accommodate said devices which restrict said framework for use with such devices.

From an economic viewpoint, sewing machines having modified frames are considered to lack versatility relative to their capability of performing different sewing operations. It is a general practice to form the framework of sewing machines with the same general configuration so as to simplify that which is required to convert a machine for the purpose of performing different and desired sewing operations. The present invention provides a device for the insertion of ornamental threads in the stitches of a seam which is easily mounted on a sewing machine and that can be easily replaced with other devices. Additionally the invention does not require modifications to the framework on which it is adapted to mount and is reliable in operation.

SUMMARY OF THE INVENTION

The device according to the invention includes a control cam located in front of the needle bar and is assembled on one end of a cam shaft that is rotatably supported by a pair of spaced and aligned bracket members that are attached to the upper portion of the machine's framework. One of these bracket members has a support plate attached thereto which includes one or more thread guide levers pivotably mounted thereon each of which is provided with a depending thread guide. This thread guide lever is caused to swing to and fro during the performance of its intended function by means of a protruding finger which extends into operative association with the control cam.

It is obvious that the supporting structure for the device according to the invention only requires appropriate threaded holes in the framework for attaching the bracket members which can also be utilized for supporting other devices, such for example as devices for measuring elastic, inserting ribbons, forming ruffles, etc.

An important object of the invention is that of providing a device for the insertion of ornamental threads that can be attached to a sewing machine having a conventional form of framework and which capable of performing a plurality of different sewing operations.

A further object is that of providing a device for inserting ornamental threads into the stitches of a seam which is of simplified construction, inexpensive to manufacture and with long life expectancy.

These and other objects of the invention will become more fully apparent by reference to the appended claims and as the following detailed description proceeds in reference to the figures of drawing wherein:

DESCRIPTION OF THE PREFERRED EMBODIMENT

Figure 1:
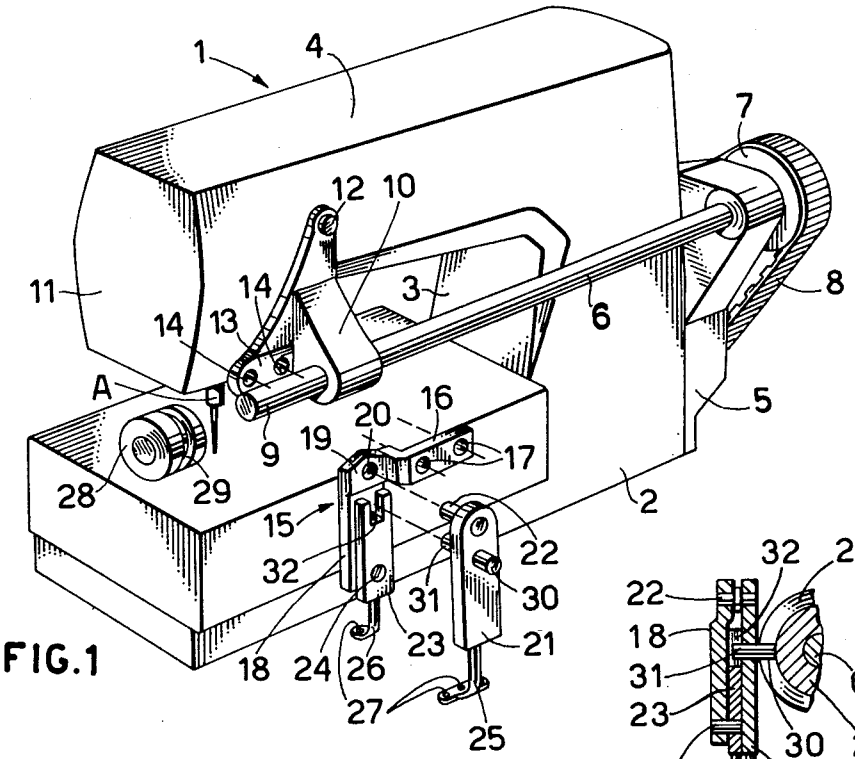
FIG. 1 is a perspective view of a sewing machine showing a portion of the elements according to the invention in exploded form.
Figure 6:
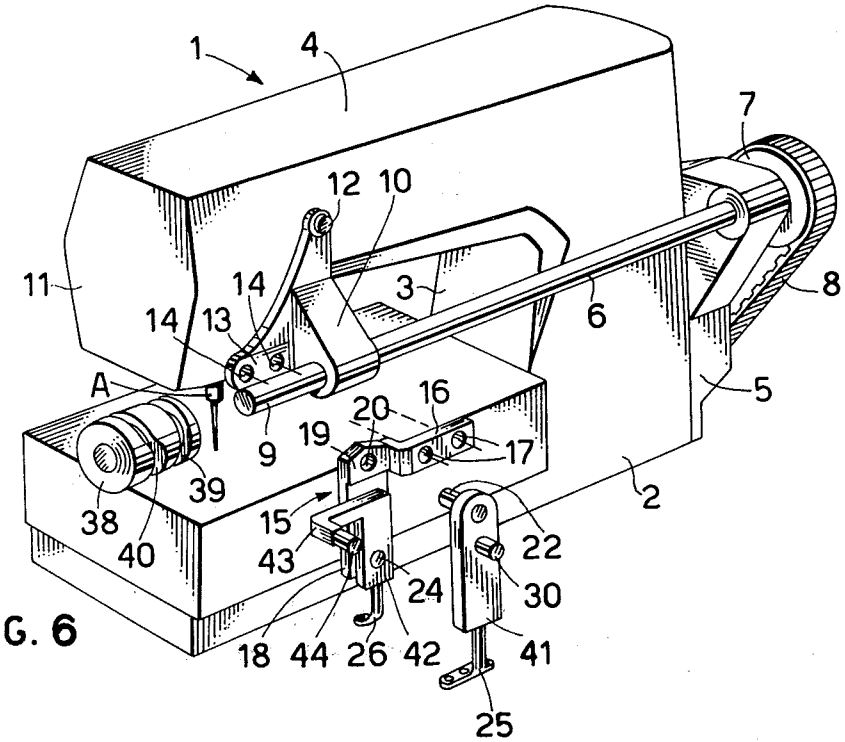
FIG. 6 is a view similar to FIG. 1 but showing a modification of the means for actuating the thread guide levers.

Referring now to FIGS. 1 and 6, the device for inserting ornamental threads according to the invention is adapted to be mounted on a flat-base type sewing machine which includes among its various parts a support framework 1 with a lower or base portion 2 within which the usual lower elements such as loopers and the feed dog (not shown) along with their respective actuating members are disposed and which function in a known manner during the stitching operation. The sewing machine also includes a column 3 that extends upwardly from the base portion 2 and serves to support the usual arm 4 which carries the customary upper stitching instrumentalities including a needle bar "A", one or more needles and a presser bar with a presser foot (not shown) as well as the actuating elements for said instrumentalities.

As shown in FIGS. 1 and 6 the column 3 has a bearing bracket 5 fixed thereto which rotatably supports a horizontally disposed shaft 6 that extends generally parallel with the arm 4 to the position adjacent to the needle bar "A". The opposite end of this shaft 6 protrudes from the bearing bracket 5 and has a driven pulley 7 assembled thereon which by means of a drive belt 8 is operatively connected with the conventional fly wheel drive pulley that forms a part of the machine's main power transmission shaft. The above driving elements of the machine have not been identified or shown for they are conventional and well known to those conversant in the sewing machine art.

That end of shaft 6 opposite the end on which the driven pulley 7 is assembled is identified by numeral 9

(FIGS. 1 and 6) and is rotatably supported adjacent this end by means of a bearing bracket 10 that is attached to the terminus portion of arm 4 which is depicted by numeral 11. The bearing bracket 10 is attached to the terminus portion 11 by means of screws 12 (one only shown in FIGS. 1 and 6) and includes a laterally extending planar surface 13 having a pair of holes 14 that serve as a means for assembling a support plate, generally indicated by numeral 15, thereto.

The support plate 15 is provided with a horizontal arm 16 having a pair of holes 17 which in assembled position are in alignment with holes 14 and serve by means of fastening screws (not shown) to assemble said support plate to the planar surface 13 of the bearing bracket 10. The body portion of the support plate 15 defines a downwardly extending plate-like member 18 having a generally rectangular configuration and an upper end portion 19 of increased thickness that is provided with a hole 20. This hole 20 serves to pivotably support a main thread guide lever 21 by means of a pin 22 assembled in the upper end of the latter. The lower part of the plate-like member 18 includes a second hole (not shown) which is adapted to pivotably support a second thread guide lever 23 by means of a pin 24 assembled in the lower part of said second thread guide lever.

Both of the thread guide levers 21 and 23 are provided with individual depending thread guides 25 and 26 respectively. These thread guides are changeable and adjustable relative to their length so as not to interfere one with the other, and each includes one or more thread eyelets 27 through which an ornamental thread extends for the purpose of being inserted into the stitches of a seam and which will be more fully described hereinafter.

When the thread guides 25 and 26 are provided with more than a single thread eyelet, the eyelets are horizontally aligned according to a transversal arrangement relative to the direction of movement of the workpiece on the sewing machine and the distance between said eyelets is equal to the distance which separates the needles one from the other.

Referring to FIG. 1 a control cam 28 is mounted on that end of shaft 6 identified by numeral 9 and is provided circumferentially with an appropriately shaped track 29 within which one end of a follower element or finger 30 is guided that is operatively associated with the thread guide levers 21 and 23.

Figure 2:
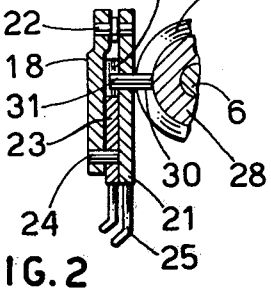
FIG. 2 is a sectional view showing the relationship between the thread guide levers and control cam in operating position.

With reference to FIGS. 1 and 2, the finger 30 is assembled in the first thread guide lever 21 below and in vertical alignment with the pin 22 of said lever and extends from the latter to the track 29 within which it is guided. The second thread guide lever 23 is disposed intermediate the first thread guide lever 21 and the plate-like member 18 and has a configuration corresponding to the lower part of the latter. A control element 31 is fixed on the first thread guide lever 21 and extends into operative association with the second lever 23 which includes a longitudinal channel 32 for receiving said control element. This operating connection causes the control element 31 to transmit to the second lever the precise oscillations which are transmitted by the control cam 28 to the first thread guide lever.

As shown in FIGS. 1 and 2, the control element defines an extention of finger 30 and extends from the first thread guide lever 21 to a position where the end thereof is positioned within the longitudinal channel 32 of the second thread guide lever 23.

The finger 30 and the control element 31 form opposite ends of a single member which is disposed intermediate the pins 22 and 24 of the two thread guide levers 21 and 23. Consequently, the oscillations transmitted by the control cam 28 to the first thread guide lever 21 are immediately retransmitted from the latter to the second thread guide lever 23, but in the inverse direction, due to the fact that the pin 24 is located below the finger 30 while the pin 22 is located above said finger.

To simplify its operation, it is preferable to form the track 29 of the control cam 28 in such a way that it will reproduce the ornamental motif according to its width so as to obtain the precise intertwining of the ornamental threads with the stitches of a seam exclusively by means of the frequency of the oscillations governed by the number of rotations of said control cam.

These oscillations have a frequency which depends on the transmission ratio between the drive pulley and the driven pulley 7.

These ratios can be, for example, 2 to 1, 3 to 1, etc. according to the type of ornamental design which it is desired to form.

Figure 3:
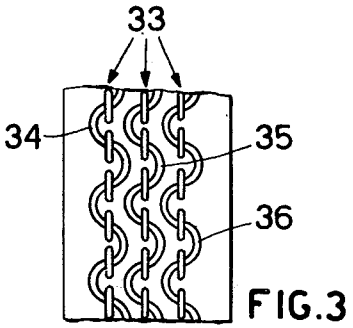
FIGS. 3, 4 and 5 are schematic views of ornamental designs obtainable with the device shown in FIGS. 1 and 2.
Figure 4:
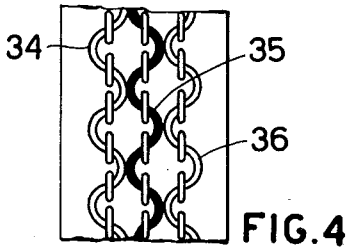
Figure 5:
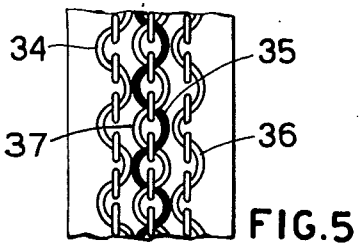

With reference to FIGS. 3, 4 and 5, the stitching instrumentalities are arranged so as to form three parallel and separate rows 33 of seam stitches, in which variously colored ornamental threads 34, 35 and 36 are adapted to be inserted. These ornameltal threads are moved from one row 33 to the other by the oscillating movements of the thread guide levers 21 and 23 and in timed sequence with the formation of the separate stitches said threads are caused to be inserted beneath the seam threads.

In the example shown in FIG. 3, a single thread guide lever is utilized having three ornamental threads which are caused to be intertwined in the rows 33 by the oscillating movement of said guide lever as well as the frequency determined by the abovementioned 2 to 1 transmission ratio.

As shown in FIG. 4, the outside ornamental threads 34 and 36 are guided by the first thread guide lever 21, while the ornamental thread 35 in the center is guided by the second thread guide lever 23 and, as heretofore described, this ornamental thread is moved synchronously with the other two threads, but in the opposite direction so as to form the ornamental effect illustrated in this figure.

In FIG. 5 the first thread guide lever 21 effects the manipulation of three ornamental threads, 34 and 36 respectively on the outer seams and 37 in the center, while the second thread guide lever 23 effects the manipulation of only the central thread 35 thus creating the ornamental effect represented in this figure of drawing.

Obviously, the examples shown are those obtainable with a 2 to 1 transmission ratio, with full movement of the guide levers from one side to the other and vice-versa during the formation of two stitches by the needles and a single turn of the control cam. Other transmission ratios may be used to vary the combination of the ornamental threads.

To increase the number of ornamental motifs obtainable with the device comprising the present invention, the control cam 28 with a single track 29 can be replaced with a modified control cam 38 having two tracks 39 and 40 as shown in FIG. 6.

The track 39 operatively engages a first thread guide lever 41 which is the same as the first guide lever 21, except that the control element 31 has been removed to eliminate its operative connection with a second thread guide lever 42.

The thread guide lever 42 is pivotably mounted on the support plate 15 in the same manner as the corresponding lever 23 in FIG. 1, but is provided with an angular shaped arm 43 extending from the upper end thereof which terminates in the form of a follower or finger 44. In assembled position the finger 44 of the thread guide lever 42 is located within the track 40 of the control cam 38. The fingers 30 and 44 are disposed in spaced relation and extend parallel one to the other in a common horizontal plane. The two tracks 39 and 40 can be formed about the periphery of the control cam 38, in such a manner so as to cause both levers to oscillate on the same side with different amplitudes or in the opposite manner and with different frequencies.

Figure 7:
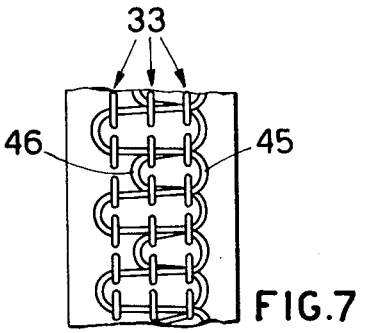
FIGS. 7, 8 and 9 are schematic views of ornamental designs obtainable by means of the modification shown in FIG. 6.

With the insertion device in FIG. 6 it is possible to obtain an ornamental motif, as shown in FIG. 7, in which a thread 45 carried by the first thread guide lever 41 is inserted simultaneously between the corresponding stitches of the three rows 33, while the thread 46 carried on the second thread guide lever 42 is inserted in the opposite direction between the corresponding stitches of the central and right-hand rows, respectively.

Figure 8:
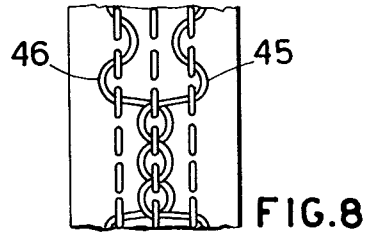
Figure 9:
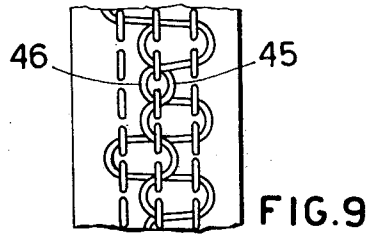

With reference to FIG. 8, the substitution of the control cam 38 for one having the tracks 39 and 40 of different configuration makes it possible to obtain an ornamental motif such as represented in this figure, in which the outside threads 45 and 46, after an independent insertion in the outside rows 33, are intertwined one with the other within the central row 33. With the provision of still another control cam 38 with tracks configured differently from those mentioned above, the ornamental motif shown in FIG. 9 can be produced. This ornamental motif is formed by the thread 45 carried by the first thread guide lever 41 by alternately intertwining it with all three rows 33 and successively in the central rows 33 and the right hand one, while the thread 46 carried by the second thread guide lever 42 is intertwined in the central row 33.

Obviously, with further variations of the transmission ratios between the drive pulley and the driven pulley 7, it is possible to increase even further the number of ornamental motifs obtainable with the use of the insertion device comprising the invention.

Although the present invention has been described in connection with a preferred embodiment it is to be understood that modifications and variations may be resorted to without departing from the spirit and scope of the invention as those skilled in the art will readily understand. Such modifications and variations are considered to be within the purview and scope of the invention and the appended claims.

I claim:

1. A device for inserting ornamental threads in stitches of seams formed on a sewing machine of the type having support framework including a base with a vertical column and an arm extending from the column for supporting the machine's needle bar having at least one needle carried thereby, the improvement comprising:

(a) a rotatably driven cam shaft journaled in spaced bearing brackets mounted on the machine and extending in a direction parallel with the arm;

(b) a control cam assembled on one end of said cam shaft adjacent the needle bar;

(c) a support plate attached to one of said bearing brackets;

(d) at least one thread guide lever pivotably mounted on said support plate which includes:

(i) a protruding finger defining a follower extending into operative association with said control cam for pivoting said thread guide lever to and fro in timed sequence with the stitching cycle; and (ii) a thread guide attached to and movable with said thread guide lever for presenting at least one ornamental thread to a position during formation of stitches for incorporation into the seam formed thereby.

2. The device according to claim 1 wherein said device includes a second thread guide lever and a thread guide carried thereby pivotably mounted on said support plate with drive means operatively connecting it to said one thread guide lever for effecting simultaneous pivotable movement therewith and in a direction inverse thereto.

3. The device according to claim 2 wherein said drive means defines a longitudinal channel in said second guide lever, and a control element defining a pin attached to and extending from said one thread guide lever into said channel.

4. The device according to claim 1 wherein said thread guide includes means defining eyelets for each ornamental thread controlled thereby with said eyelets being aligned in a plane extending normal to the direction of movement of a workpiece and spaced one from the other a distance equal to the spacing of the needles carried by the needle bar.

5. The device according to claim 1 wherein said device includes a second thread guide lever and a thread guide carried thereby pivotably mounted on said support plate with drive means operatively connecting it to said control cam for effecting simultaneous pivotal movement thereof with said one thread guide lever.

6. The device according to claim 5 wherein said drive meand includes an angular arm attached to and extending from said second thread guide lever having a terminus end defining a follower disposed in operative association with said control cam.

* * * * *